United States Patent [19]

Goldschmidt

[11] Patent Number: 5,062,326

[45] Date of Patent: Nov. 5, 1991

[54] POWER-DRIVEN OR MANUALLY-OPERATED WRENCH PULLER FOR TIGHTENING OR LOOSENING THREADEDLY-ENGAGED WORK PIECES

[76] Inventor: Steven H. Goldschmidt, 10 Greenbrier Dr., Bloomfield, Conn. 06002

[21] Appl. No.: 616,838

[22] Filed: Nov. 21, 1990

[51] Int. Cl.[5] ..... B25B 13/00

[52] U.S. Cl. ..... 81/57.32; 81/57.34; 81/57.39

[58] Field of Search ..... 81/52, 54, 57.16, 57.22, 81/57.32, 57.34, 57.36, 57.39

[56] References Cited

U.S. PATENT DOCUMENTS

| | | | |
|---|---|---|---|
| 378,299 | 2/1888 | Finch | 87/57.32 |
| 1,385,228 | 7/1921 | Reynolds | 87/57.32 |
| 1,522,083 | 1/1925 | Stensrud | 81/57.32 X |
| 2,540,553 | 2/1951 | Shobe | 81/57.32 |
| 4,591,288 | 5/1986 | Schmidek et al. | 81/57.39 X |

FOREIGN PATENT DOCUMENTS

| | | | |
|---|---|---|---|
| 552230 | 1/1923 | France | 81/57.32 |

*Primary Examiner*—James G. Smith

*Attorney, Agent, or Firm*—Ross, Ross & Flavin

[57] ABSTRACT

A connector torquing system useful for tightening or loosening a pair of interthreaded components is shown. A torque receiving means is spaced about each of the interthreaded components concerned. A gimbal is disposed at the opposite extremity of each torque receiving means and includes inner and outer pivot blocks swingable with respect to each other in mutually perpendicular axes. Each torque receiving means is connected to its respective gimbal. A screw is extendable between and through each gimbal. A pair of nuts are threadedly engaged on the screw outboard of an adjacent one of the gimbals and the nuts of the pair are tightened. A single nut is threadedly engaged on the screw within an adjacent one of the gimbals and aids in the rotation of the screw responsive to the tigthening of the nuts of the pair. In this way concomitant angular deviation of the inner and outer pivot blocks of the gimbals achieves the displacement of the torque receiving means as they are driven toward each other.

4 Claims, 4 Drawing Sheets

FIG. 11A.
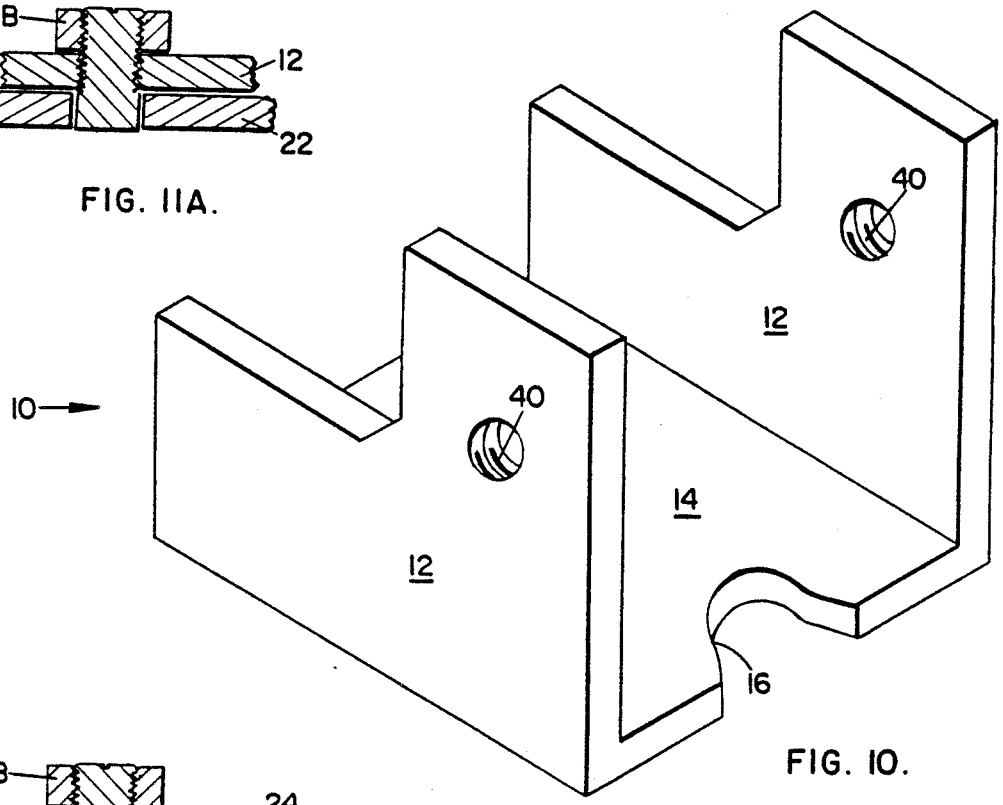
FIG. 10.
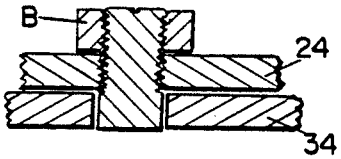
FIG. 11.
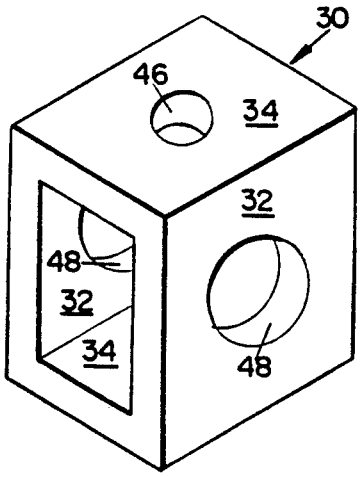
FIG. 12.
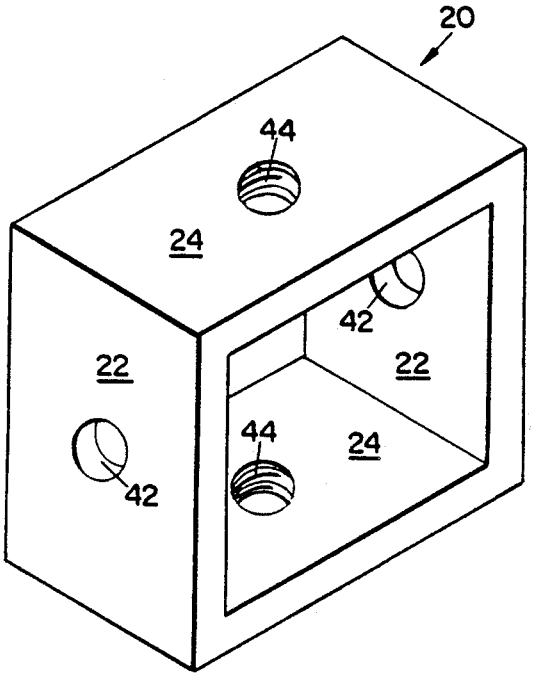
FIG. 13.

POWER-DRIVEN OR MANUALLY-OPERATED WRENCH PULLER FOR TIGHTENING OR LOOSENING THREADEDLY-ENGAGED WORK PIECES

BACKGROUND OF THE INVENTION

Field of the Invention

The invention relates to new and useful improvements and structural refinements in wrench pullers having general utility in the arts, and more particularly aims to provide a lightweight, inexpensive tool for applying a heavy pressure to the pulling or turning of wrenches for the tightening or loosening of a pair of threadedly engaged connectors or workpieces.

The above elucidated concept has been embodied into a practical concept for solving the vexing problems associated with the use of wrenches in connection with threaded connectors such as piping where it is desired to tighten or to loosen the connection.

The apparatus advantageously eliminates the need for any wrench extensions, so important where limited operating space is a factor and where short handle and short turning action in close quarters are desiderata, for example on concealed piping or close under floors or against walls or in narrow trenches.

OBJECTS OF THE INVENTION

It is one object of the present invention to provide a tool of the character described which can be easily modified to suit the particular type of workpiece to be involved and/or the size of the wrench to be employed therewith.

In one degree of lexicography, the apparatus might be delineated a screwing tool for developing a requisite torque for the tightening or loosening of bolting or other threadedly interconnected workpieces.

SUMMARY OF THE INVENTION

Broadly considered, the wrench puller is based on the screw principle with a torque being appliable to a pair of nuts in threaded engagement with a tie rod to achieve a turning of the tie rod whereby to draw the wrenches toward each other. The effort applied to the nuts is multiplied myriad times so as to offer an unbelievable torque on the wrenches.

The exemplification illustrated in the drawings demonstrates the invention based upon the screw thread principle. When torque is applied to twin nuts at one extremity of a threaded tie rod, the tie rod is turned so as to be screwed into a single nut at the opposite rod extremity, wherefor the wrenches are drawn toward each other. Pushing wrenches away from each other would put the tie rod in compression which would bend or buckle the rod. In tension, the rod is very strong.

A gimbal arrangement is provided in turrent structure, there being one at each extremity of the tie rod, allowing pivotal or swiveling movements about mutually orthogonal axes. That is, the center lines of the inner and outer components of the gimbal are substantially perpendicular to each other, so as to preclude any warping or bending of the tie rod as it serves the function of rotating to draw together or apart the operating wrenches of a pair. The changing angle of the wrenches is what threatens the bending of the tie rod.

Each component of the workpiece is engaged by a corresponding radially-extending wrench. The wrenches of the pair are pivotally tied together at the outer ends of their handles via a threaded tie rod, with the wrenches rotating concurrently about the axis represented by the workpiece.

Electric motor driven or hydraulically or pneumatically powered means or simple manually operated means for rotating the twin nuts offer the desired mechanical advantage for the screwing or unscrewing of the respective interthreaded components of the workpiece.

The apparatus can be easily set up and operated by a single operator of no particular strength as compared with heretofore known sytems dictating the services of at least two workmen and usually necessitating the leverage possibilities afforded only by wrenches with long extensions thereto.

The apparatus is especially well suited for applications involving the disassembly of old piping having rusted joints.

The parts of the whole arrangement are preferably detachable so that the sizes of the wrenches used can be varied together with their radial arrangement so as to suit various arrangements of bolts or nuts and/or various diameters of the workpiece.

It is even conceivable, again where the space question is an all-important consideration, that the wrench handles themselves can actually be foreshortened, the leverage they normally provide finding substitution therefor in the very power of the apparatus of this invention.

Wrenches of all types are comprehended for use herewith, including wrenches of the adjustable, open end, box, chuck, key, ratchet, set screw, socket, spanner, straight, angle, pipe (Stillson), pipe (Vulcan chain), screw or monkey, and tap types.

BRIEF DESCRIPTION OF THE DRAWINGS

FIG. 10 is a large scale view in perspective of the outer housing of the pivot assembly;

FIG. 11 is a fragmentary detail view of the pivot arrangement of the outer housing and outer pivot block of the pivot assembly;

FIG. 11A is a fragmentary detail view of the pivot arrangement of the outer and inner pivot blocks of the pivot assembly;

FIG. 12 is a view in perspective of the inner pivot block; and

FIG. 13 is a view in perspective of the outer pivot block.

DESCRIPTION OF THE PREFERRED EMBODIMENT

A pair of standard commercially available variably adjustable pipe wrenches W and WW are employed for serving the known function of exerting a twisting strain, as in the turning of bolts, nuts, pipes or the like. In the illustration provided, conventional monkey type wrenches are disclosed; although, as aforesaid, other conventional type wrenches can be substituted therefor, depending on the particular work problem contemplated.

Each wrench will incorporate the usual moving mechanical elements between the straight handle, or drive means, and the work-engaging means consisting of variably adjustable jaws for accommodating to work of different dimensions. The jaw system incorporates a stationary jaw representing an inner extremity of the handle and a separate movable jaw movable toward and away from the stationary jaw by any known adjusting arrangement. A threaded arrangement is shown, but a rack and worm arrangement could be easily substituted therefor. The jaw system is adapted to non-rotatably fit over a pipe or pipe fitting or other component of a workpiece. The handle extends radially and outwardly of the workpiece.

The wrenches are adapted to be each gripping about adjacent components of an interthreaded or otherwise interengaged workpiece, for example, a pipe and pipe fitting threaded together.

The wrench shown is specially adapted for grasping or clutching a round workpiece, the oppositely facing work surfaces of the jaws being provided with a selected type of knurling for effective gripping of a component of the workpiece, with the jaws being swingable with the handle as the radially-extending wrench rotates about the axis of its workpiece in the tightening or loosening mode.

The wrenches are envisioned to have relatively long handles peculiarly adapted for engaging work with leverage at a distance, but as aforesaid, the invention lends itself to the employment of short-handled wrenches, their being foreshorted in order to make them more adaptable to any particular application being comprehended.

Conceivably equally satisfactory results could easily be obtainable with systems incorporating an hydraulic cylinder and pump, or winch and cable, or ratchet type jack.

Figure 1:
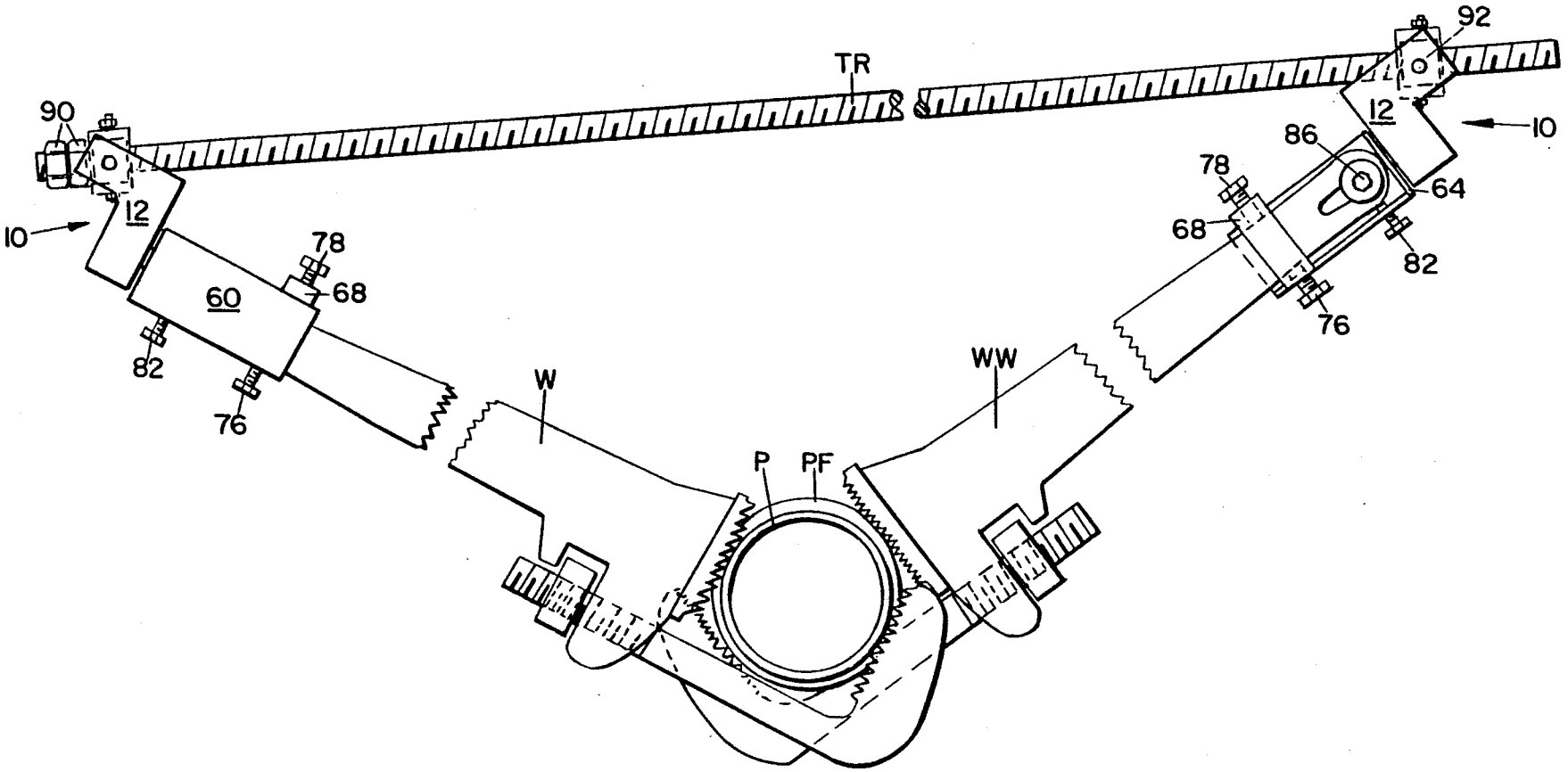
FIG. 1 is a broken view, in side elevation, showing the apparatus of the invention.
Figure 2:
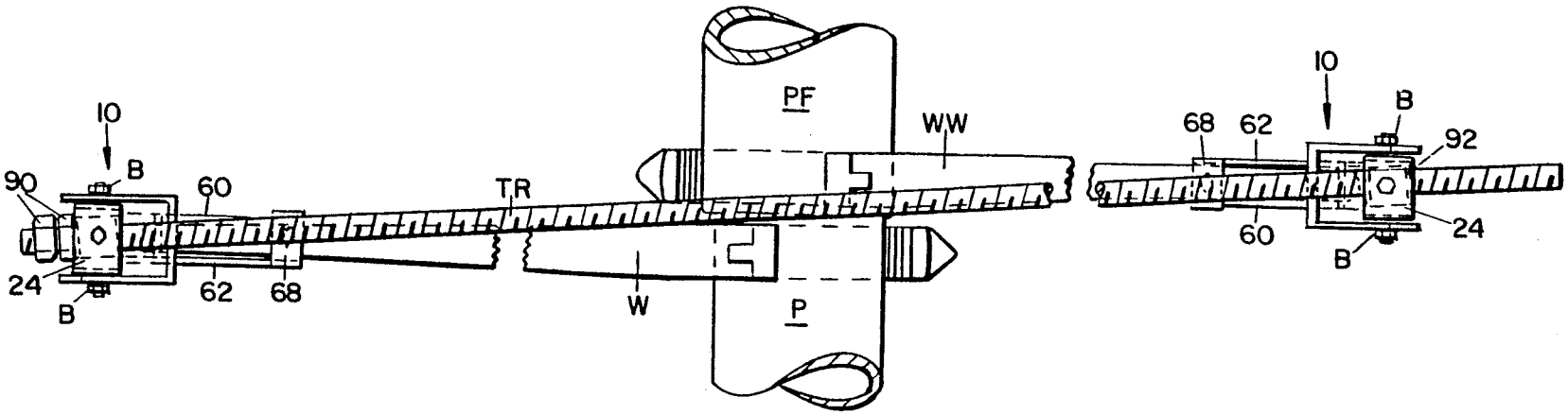
FIG. 2 is a broken view, in top plan, showing the FIG. 1 apparatus.

As shown in FIGS. 1 and 2, a workpiece comprised of pipe P and pipe fitting PF are in threaded interengagement, and the assembly shown in association therewith is in the ready-to-operate position for tightening the connection between the two components of the workpiece. In order to loosen the connection wrench W would be attached to the pipe fitting PF and wrench WW attached to pipe P.

A turret is provided adjacent the outboard end of each wrench handle and includes a U-shaped housing, indicated generally by reference numeral 10, and comprised of a pair of spaced parallel side walls 12, 12, interconnected by a cross arm 14 which is provided with an inwardly extending recess 16 from one end edge for accommodating to passage therethrough of a threaded tie rod TR. See FIG. 10.

Shown in FIG. 13 is an outer pivot block, generally indicated by reference numeral 20, which is of generally quadrilateral configuration with spaced parallel side walls 22 and spaced parallel top and bottom walls 24. Outer pivot block is nestably receivable within housing 10.

Shown in FIG. 12 is an inner pivot block, generally indicated by reference numeral 30, which is of generally square configuration, having spaced parallel side walls 32, 32 and spaced parallel top and bottom walls 34, 34. Inner pivot block is nestably receivable within outer pivot block 20.

Side walls 12, 12 of outer housing 10 are provided with aligned threaded through openings 40, 40, and side walls 22, 22 of outer pivot block 20 are provided with through openings 42, 42 alignable with respective through openings 40, 40, with the components in their nested operative positions.

Outer pivot block 20 is provided with centered aligned threaded through openings 44, 44 through top and bottom walls 24, 24, and inner pivot block 30 is provided with centered aligned through openings 46 and 46 (one of which is shown in FIG. 12), to the end that when outer and inner pivot blocks are brought into nested assemblage, those openings are alignable.

Additionally, inner pivot block, sized to prevent the rotation of nut 92, is provided with enlarged centered through openings 48, 48 in walls 32, 32 through which tie rod TR is extendable.

The turret thus defines a gimbal, outer pivot block 20 being mounted for rotation about a first geometrical axis, and inner pivot block 30 being mounted for rotation about a second geometrical axis whereby the inner and outer pivot blocks are permitted independent movement about first and second mutually perpendicular reference axes, ergo the gimbal effect allowing the swivelling or rotating or pivoting of the pivot blocks about their horizontal or vertical center lines.

A wrench puller attachment or connector means is provided for interconnecting the outboard end of the handle of each wrench and the associated gimbal and tie rod TR related therewith by virtue of its passage therethrough.

The wrench puller attachments or connectors, there being a pair thereof, one for accommodating each wrench, are identical in structure.

Each comprises a generally rectangularly configured base 60 with an upstanding side wall 62 integral with and extendable along the length thereof.

Figure 6:
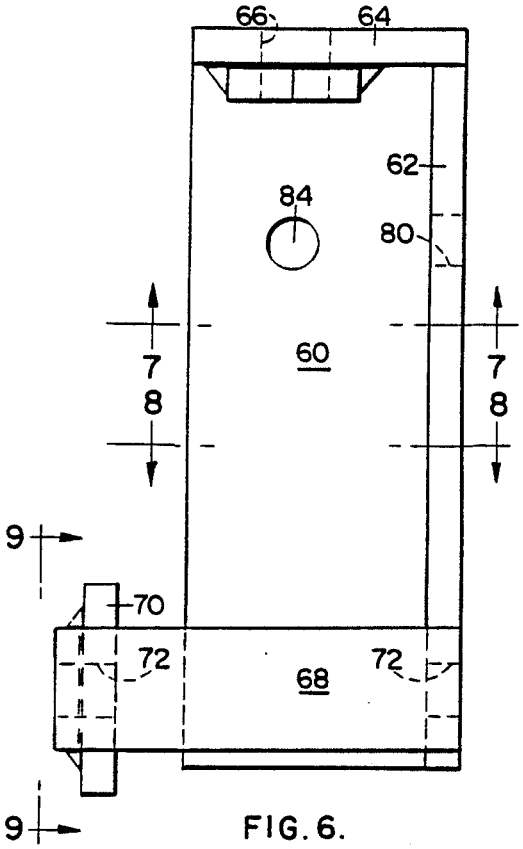
FIG. 6 is a side elevational view of the FIG. 5 attachment without the associated wrench.
Figure 5:
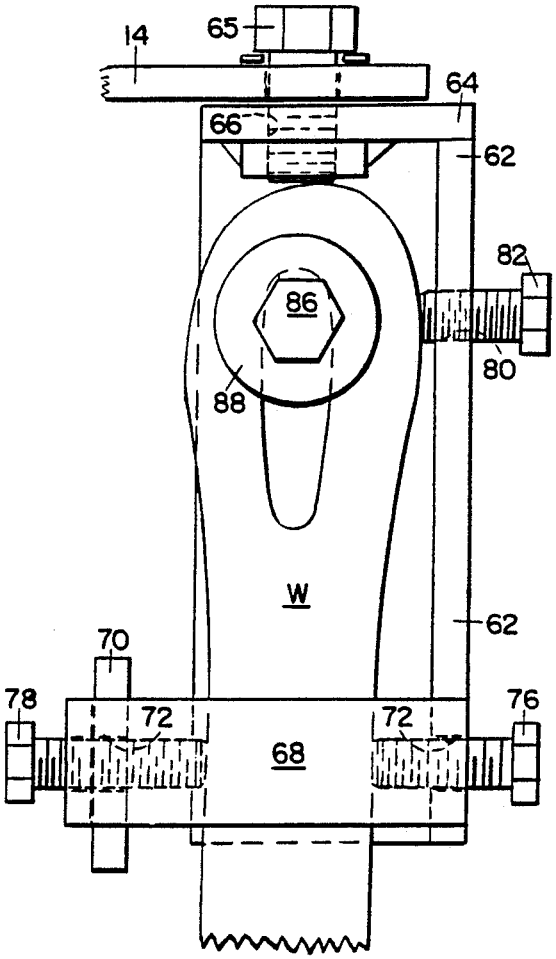
FIG. 5 is a view on an enlarged scale, in side elevation of a wrench puller attachement of the invention showing the outboard end of the handle of an associated wrench.
Figure 7:
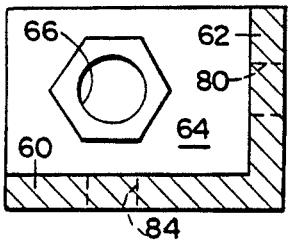
FIGS. 7, 8 and 9 are sectional views on lines 7—7, 8—8, and 9—9 respectively of FIG. 6.
Figure 8:
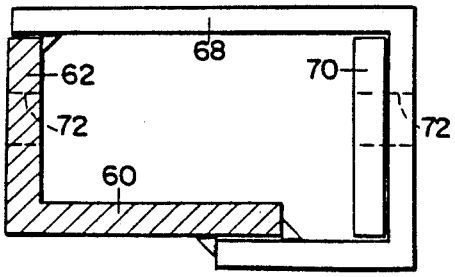
Figure 9:
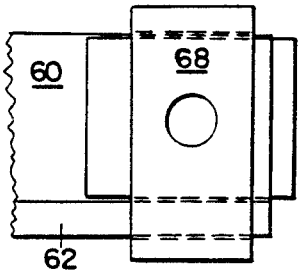

An outboard end of base 60 is provided with a perpendicular cross arm 64 provided with a centered threaded through opening 66 and at the opposite inboard end a U-shaped cross arm 68 is provided, same having an upper arm spaced upwardly of the plane of the base as shown in FIG. 6 for the accommodation thereunder of the handle extremity of wrench W as shown in FIG. 5. A lower arm of cross arm 68 is fixed as by a weldment to the underside of base 60.

At one side of cross arm 68, a downwardly-depending arm 70 is welded thereto with threaded openings 72, 72 being provided through side wall 62 and depending arm 70 respectively for the reception of inwardly-extending bolts 76 and 78 respectively wherewith to tightly embrace opposite side walls of the accommodated wrench. This arrangement allows the reception of tools of varying widths.

Another threaded opening 80 through side wall 62 receives a bolt 82 so as to tightly embrace the side wall of the accommodated wrench.

A tapped through opening 84 is provided in base 60 for the reception of a bolt 86 where, with the aid of an accommodating washer 88, the wrench may be held secure to the base.

Cross arm 64 is provided with a threaded opening 66 for the reception of a bolt 65 for embracement with the outboard end of the wrench for assisting in its lock-in and attachement of the outer housing of the pivot assembly.

Figure 3:
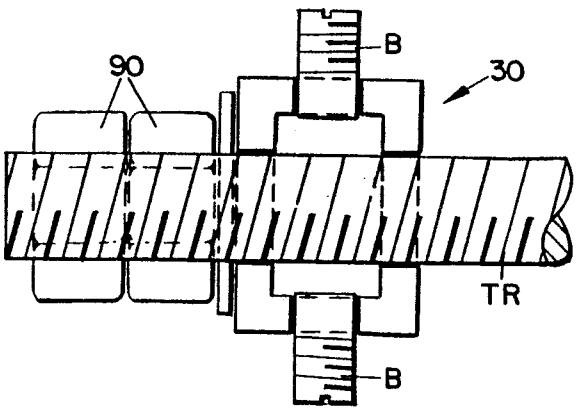

A pair of twin nuts 90, 90 tightened to each other are provided at one extremity (the leftward extremity as shown) of the tie rod TR, outboard of the respective turret, only the inner pivot block 30 of which is shown in FIG. 3 for the sake of clarity.

Figure 4:
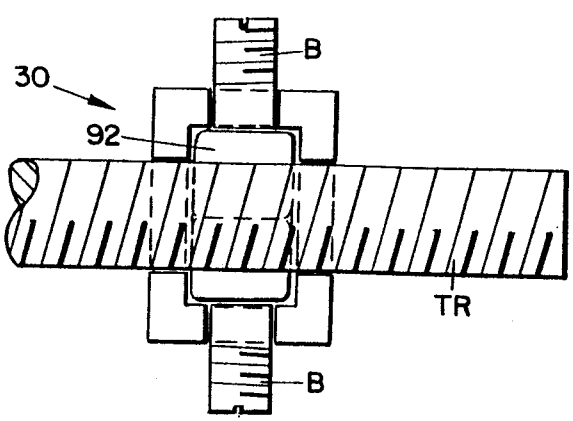
FIGS. 3 and 4 are large scale views of the left hand and right hand turrets respectively.

With a torque applied to twin nuts 90, 90, tie rod TR will be screwed into a single nut 92 at the opposite end, which nut is nested within respective inner pivot block 30, see FIG. 4, all so as to effect a drawing of the two wrenches together, the effort applied to the twin being multiplied by a great multiplicity of times so as to allow a tremendous pulling force on the wrenches.

The resulting ratio (an increase of force upon tie rod rotation being proportional to a concomitant decrease in distance along the tie rod) can be readily changed by a simple substitution of tie rods and cooperating nuts of differing threads.

Too, a motorized version may be readily improvised by the insertion of a driver into a drill (electric or pneumatic) or an impact wrench or any equivalent hydraulic or pneumatic drive means.

It is further comprehended that the tie rod may be modified into a so-called turnbuckle arrangement, as with a left hand thread along the leftward half of its length and a right hand thread along the rightward half of its length acting with cooperant single nuts in each of the gimbals at the opposite ends of the tie rod, whereby to increase the operating speed by doubling same. Admittedly, however, such would see a resultant power reduction by one-half.

The action is toggle-like in nature in the sense that it permits the jointing together of two wrenches, each secured to separate components of a workpiece in instances where the desideratum is to tighten or loosen the components from each other.

Thus the wrenches are pivotally and adjustably attached at their outer ends to one another by means of the respective attachments and gimbals and tie rod therebetween to form a tying circle.

The tie rod, by its rotative movement, serves as a rotating force on the tying circle to adjust the distance between the outer ends of the wrenches.

Limited pivotal movement of the wrench handles is allowed.

The gimbal arrangement allows the rotating or pivoting of the wrenches, as the inner and outer pivot blocks pivot on their horizontal and vertical center lines, responsive to the tie rod rotation. By such responsiveness, bending of the tie rod is precluded, an unwanted feature common to earlier versions of the arrangement before the gimbal feature was adopted.

Should the rotative tie rod extendable through single nut 92 arrive at a point where further extension is encumbered by the presence of some obstacle, one of twin nuts 90 can be disengaged and threaded onto the opposite end of the tie rod so as to be tightened against its respective turret. A further tightening of the reaming nut 90 of the twin nut arrangement will then cause a further extension of the tie rod to be in the opposite direction.

I have also found that a flat or a slot running axially of the full tie rod length with a mating part in each of the turrets will serve to allow a sliding through of the tie rod while simultaneously precluding the turning thereof. In this manner, possible tie rod twisting is further precluded. Further with this arrangement single nuts would be tightenable against the outboard face of each respective turret. Such an arrangement would serve to preclude the employment of any of the standard socket wrenches, but workable commercially available tools could be employed for such instances.

I have found that wrenches with large jaws and short handles work particularly well with this invention.

The claims are desired to include within the scope thereof all of said suitable variations, modifications and equivalents by which substantially the results of the invention may be obtained through the use of substantially the same or equivalent devices or means. Accordingly, limitation hereof should only be made as determined by a proper interpretation of the prior art and the scope of the subjoined claims, in which it is my intention to claim all novelty inherent herein as broadly as possible.

Having thus described my invention in an exemplary embodiment, what I therefore particularly point out and distinctly claim as new and desire to secure by Letters Patent:

1. In a manually or mechanically or hydraulically or electrically operated wrench puller system for tightening or loosening a threaded connection in a workpiece with a multiplied pulling force comprising:

a pair of wrenches each grippingly engaged with one of the threaded components of the workpiece, a turret disposed at the opposite extremity of each wrench and including independently pivotable and rotatable inner and outer pivot blocks swingable with respect to each other in a substantially friction free manner in mutually perpendicular axes, a connector means connecting each wrench to its respective turret, a threaded tie rod extendable between and through each turret, a pair of nuts tightened together and threadedly engaged on the tie rod outboard of an adjacent one of the turrets, single nut threadedly engaged on the tie rod within an adjacent one of the turrets, adapted and arranged whereby rotation of the tie rod responsive to the tihghtening of the pair of nuts effects concomitant angular deviations of the inner and outer pivot blocks of the pair of turrets and the resultant axial displacement of the wrenches as they are driven toward each other.

2. A connector torquing system for tightening or loosening a pair of interthreaded components consisting of:

torque receiving means generally spaced about each of the interthreaded components, a gimbal disposed at the opposite extremity of each torque receiving means and including inner and outer pivot blocks swingable with respect to each other in mutually perpendicular axes, a connector means connecting each torque receiving means to its respective gimbal, a screw extendable between and through each gimbal, a pair of nuts tightened together and threadedly engaged on the screw outboard of an adjacent one of the gimbals, a single nut threadedly engaged on the screw within an adjacent one of the gimbals, with rotation of the screw responsive to the tightening of the nuts of the pair achieving concomitant angular deviations of the inner and outer pivot blocks of the pair of gimbals and the resultant displacement of the torque receiving means as they are driven toward each other.

3. A manually or power operated wrenching system for tightening or loosening interthreaded connectors comprising:

torque receiving means having an inner end spaced about and engaging each of the threaded connectors, a turret disposed adjacent the outer end of each torque receiving means inclusive of independently rotatable inner and outer pivot blocks swingable in an unrestricted manner in mutually perpendicular axes, a connector means connecting each torque receiving means to its respective turret, a drive means extendable between and through each turret for applying a torque to the torque receiving means and thereby to the interthreaded connectors, a pair of nuts tightened together and threadedly engaged on the drive means outboard of an adjacent one of the turrets, a single nut threadedly engaged on the drive means within an adjacent one of the turrets, whereby rotation of the driving means responsively to the tightening of the nuts of the pair effects concomitant swinging movements of the inner and outer pivot blocks of the turrets of the pair and the resultant axial displacement of the torque receiving means as they are driven toward each other.

4. Apparatus for generating torque comprising, a pair of wrenches each having a wrench head engageable with one of a pair of threaded components of a workpiece, an extension of each wrench opposite the wrench head for fixed securement to the respective wrench, puller a turret connected to each extension and including independently pivotable and rotatable inner and outer pivot blocks swingable with respect to each other in mutually perpendicular axes, a threaded output shaft extendable between and through each turret, a pair of nuts tightened together and threadedly engaged on the output shaft outboard of an adjacent one of the turrets, a single nut threadedly engaged on the output shaft within an adjacent one of the turrets, all arranged whereby rotation of the output shaft responsive to the tightening of the pair of nuts imparts concomitant angular deviations of the inner and outer pivot blocks of the pair of turrets permitting translation movements of the wrench heads and rotational manipulation of the components of the workpiece.

* * * * *